United States Patent [19]

Müller et al.

[11] 4,305,603

[45] Dec. 15, 1981

[54] SNOW GLIDER

[75] Inventors: Marcel Müller, Zeihen; Urs Müller, Basel, both of Switzerland

[73] Assignee: Müller & Müller, Basel, Switzerland

[21] Appl. No.: 100,862

[22] Filed: Dec. 6, 1979

[51] Int. Cl.[3] ..... A63C 5/04

[52] U.S. Cl. ..... 280/607; 9/310 A; 280/124; 280/609; D21/229

[58] Field of Search ..... 280/609, 601, 606, 607, 280/12 H, 18, 19, 600; 9/310 A, 310 R, 310 E, 310 B; D21/229, 228, 224, 236; D12/11, 10, 9, 8, 7, 6

[56] References Cited

U.S. PATENT DOCUMENTS

| | | | |
|---|---|---|---|
| 1,644,623 | 10/1927 | Ahn | 280/606 X |
| 2,055,757 | 9/1936 | Tolman | 280/609 |
| 2,181,391 | 11/1939 | Burgeson et al. | 280/18 |
| 3,378,275 | 4/1968 | Rockwood et al. | 280/609 X |
| 3,534,972 | 10/1970 | Salerno | 280/609 |
| 3,579,682 | 5/1971 | Wood | 280/18 X |
| 3,628,804 | 12/1971 | Carreiro | 280/609 X |
| 3,900,204 | 8/1975 | Weber | 280/607 |
| 3,947,049 | 3/1976 | Pedersen | 280/609 |

FOREIGN PATENT DOCUMENTS

| | | | |
|---|---|---|---|
| 167195 | 11/1950 | Austria | 280/600 |
| 2711930 | 9/1978 | Fed. Rep. of Germany | 280/12 H |
| 1285809 | 1/1962 | France | 280/609 |

*Primary Examiner*—Joseph F. Peters, Jr.
*Assistant Examiner*—Milton L. Smith

[57] ABSTRACT

A snow glider in the form of an elongated glide plate (1), the upper side of which has at least one stand-on area (2, 3) for the feet of the user and the front part of which is bent upwards in the manner of ski tips. The glide plate (1) is wider at the rear than at the front and in the middle, this wider rear part (6) being bent upwards out of the plane of the middle part (5). The snow glider makes free smooth running on snow possible, changes in the direction of running being effected by a corresponding shift of the center of gravity of the body.

5 Claims, 9 Drawing Figures

SNOW GLIDER

TECHNICAL FIELD

The invention relates to a snow glider which consists of an elongated glide plate which is bent upwards at the front in the manner of ski tips and has, on its upper side, at least one stand-on area for the feet of the user.

BACKGROUND STATE OF THE ART

Swiss Patent Specification No. 583,046.

From skiing, so-called monoskis are already known, wherein a stand-on plate, which carries two bindings arranged side by side, is supported on a single ski. Since the feet of the user are fixed, parallel to one another, on the stand-on plate and since only one single ski is used, it is very difficult to keep one's balance and this is only possible while moving. At a standstill, the skier must support himself by sticks so that he does not fall over. From the point of view of the course of motion, monoskiing is a special and even difficult type of conventional skiing on two skis.

In another modification of monoskiing, it has already been proposed to arrange two bindings one behind the other on a single short ski. In this way, it was intended to shorten the relatively long ski section behind the binding, which section can be moved sideways only with great difficulty when running on one ski, and to facilitate turning the ski when changing direction. Even here, however, there is the disadvantage that particular practice and skill are necessary for using a ski of this type and that the same difficulties arise with respect to the balance during running and at a standstill. The reason is that, since both feet are placed one behind the other in longitudinal alignment, a large effort becomes necessary for keeping balance. With a short ski of this type, it is also relatively difficult to effect braking.

A real snow glider of the initially mentioned generic type is known from Swiss Patent Specification No. 583,046. This snow glider comprises a glide plate which is designed as a stand-on area for both feet of the user and which, in the rear zone, is divided by a slit. At the front, the plate is bent upwards and fitted with one or two rod-like hold-on devices, which are pivotally joined to the glide plate, for the two hands. There are no bindings provided which can give a hold for the feet so that steering movements by shifting the weight can be carried out only to a limited extent. A change of direction must be effected predominantly with the arms by means of the stick-like hold-on devices, and this requires a very great effort with the upper part of the body. A smooth course of motion is not possible. There are also difficulties in using a ski lift since the stick-like rods must be held continuously in order to prevent the glider slipping away under the feet, and since there is thus no free hand left for holding on to the drag bar of the ski lift.

On the other hand, from another type of sport which is not meant to be carried out on snow, skateboards are known which consist of a stand-on plate with rollers and two axles which can be steered by laterally shifting the weight. The user stands with both feet in a loose holder in a straddle-like position on the stand-on area of the skateboard, both feet being placed at a slight angle to the transverse axis. The steering movement effected by shifting the weight represents a smooth course of motion of the body and its path. To be able to maintain balance on the board mounted on rollers, however, youthful agility is required. The sport is practiced on inclined bitumen surfaces or concrete surfaces, so that any falls which may occur are very hard and frequently involve injuries. Due to the lack of suitable grounds, the sport is frequently practiced also on the road, contrary to traffic regulations, and this is of course highly dangerous.

DISCLOSURE OF THE INVENTION

The present invention comprises a snow glider of the initially indicated type, wherein the rear part of the glide plate is wider than its front and middle parts, and wherein this wider rear part is bent upwards out of the plane of the middle part. It is particularly advantageous to shape the wider rear part of the glide plate in the form of a delta wing and, on the underside, to provide two runners which extend parallel to the rear rim and ensure a good steering action.

The invention provides danger-free ski sport equipment for all ski paths and types of snow; the user stands freely and upright on the equipment and accomplishes smooth running in curves on the snow, which can be learned quickly, without sticks or other aids by simply shifting the weight of the body in the direction of the center point of the curve.

The equipment can be braked rapidly and safely in any situations and the high risk of fractured legs, which is always present in skiing, is avoided. Expensive equipment, such as ski boots, sticks, bindings and the like, are no longer necessary. The equipment is also economical to manufacture and to purchase. It has a low weight, is not bulky and can be transported conveniently. Thus, this snow glider combines the advantages of monoskiing, skateboarding and water-surfing without having the disadvantages of these.

BRIEF DESCRIPTION OF THE DRAWINGS

An illustrative embodiment of the invention is represented in the drawings in which, in detail.

BEST METHOD FOR ACCOMPLISHING THE INVENTION

Figure 1:
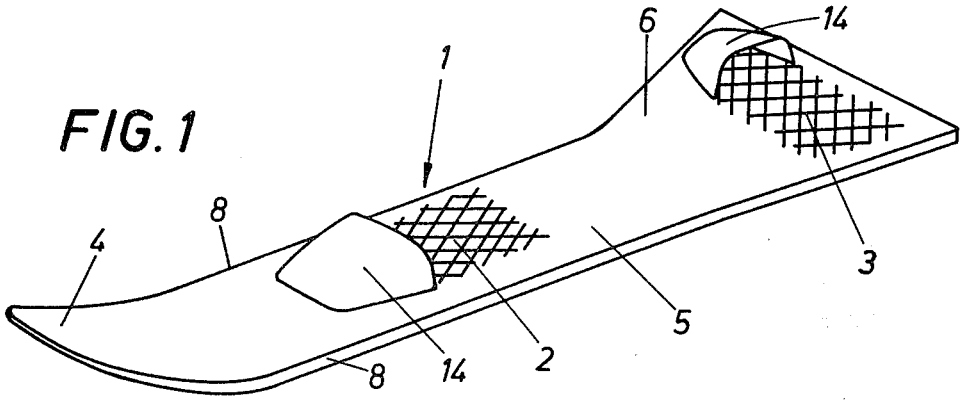
FIG. 1 shows a perspective view of a snow glider.
Figure 2:
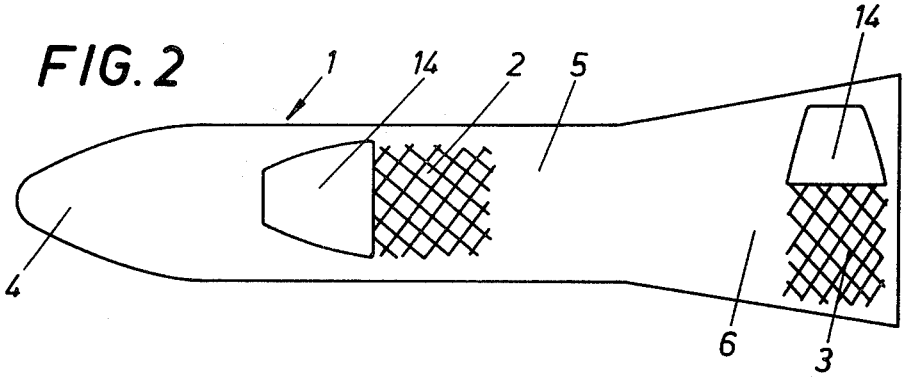
FIG. 2 shows a plan view of the snow glider according to FIG. 1.
Figure 3:
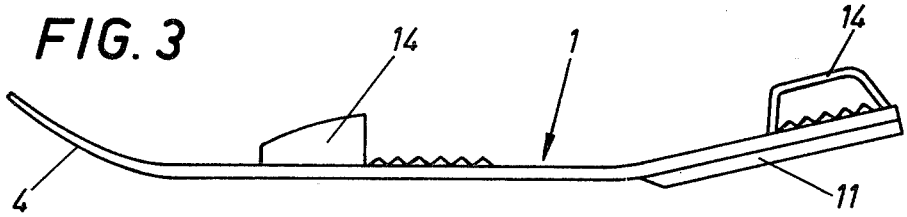
FIG. 3 shows a side view of the snow glider according to FIG. 1.
Figure 4:
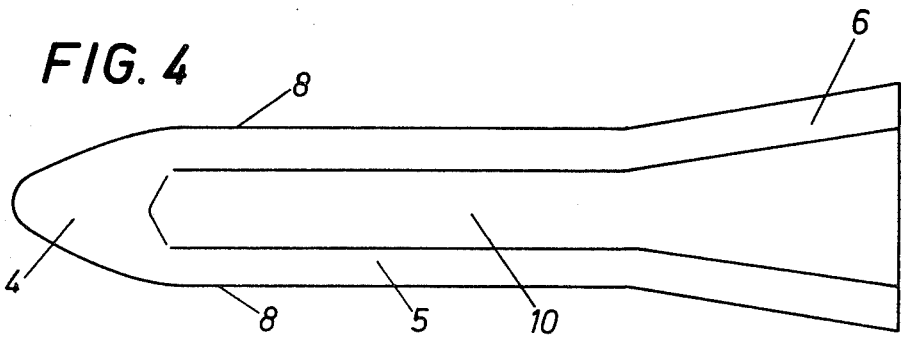
FIG. 4 shows a view of the snow glider, according to FIG. 1, from below.

The snow glider according to FIGS. 1 to 4 consists of an elongated glide plate 1 which, on the upper side, is provided with stand-on areas 2, 3 for the feet of the user. The front part 4 of the glide plate 1 is bent upwards in the manner of a ski tip. The middle part 5 of the glide plate is of flat shape and has approximately the same width over the entire length.

Adjoining the rear of the middle part 5, the glide plate 1 is widened, this wider rear section 6 being bent upwards out of the plane of the middle part 5. The bending of the rear part can be effected at an angle or it can proceed as a uniformly upwardly-arched curvature.

Figure 8:
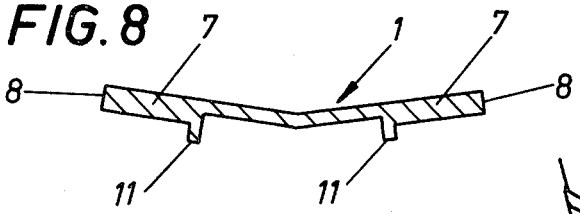

Viewed from above, the rear part 6 has a triangular or delta shape. Depending on the snow conditions and terrain conditions, it can be also advantageous to bend the side surfaces 7 of the rear part 6 laterally upwards like a wing, as shown in FIG. 8. Alternatively, still viewed from above, the rear part 6 could also have another shape instead of a triangular shape, in which case the lateral rims 8 would then no longer be straight, but would run outwards like a curve. The transition of the rims 8 from the middle part to the rear part could also be uniformly curved, instead of being at an angle. In a further embodiment, the rearmost rim zones of the rear part 6 could be mutually parallel or could run inwards again.

Figure 6:
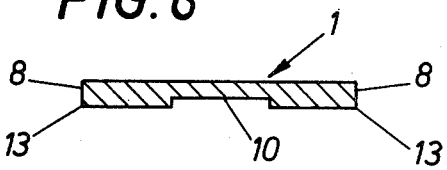
FIGS. 6–8 show cross-sections of further embodiments of snow gliders and FIG. 9 shows a snow glider with the user in the running position.
Figure 7:
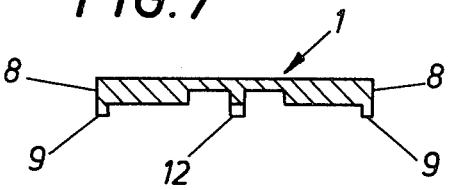

To avoid excessive slipping on snow, in particular on hard ski paths, the rims 8 can be provided with biting edges, for example steel edges 13 (FIG. 6) or also with runners 9 (FIG. 7). The edges 13 or runners 9 can be arranged over the entire length of the glide plate or only on the rear section.

Figure 5:
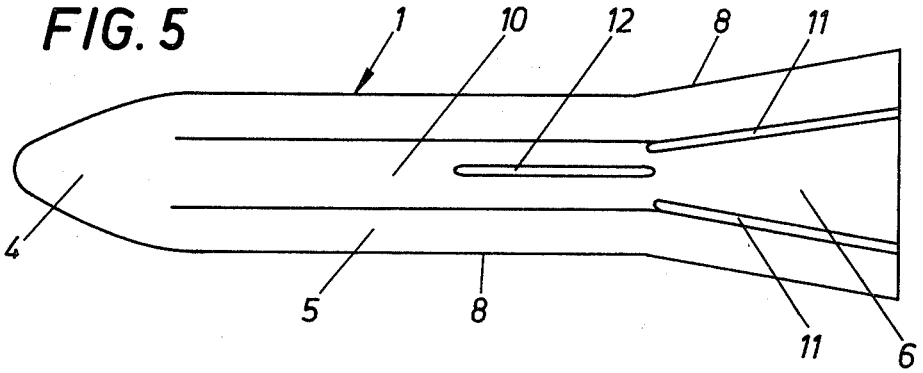
FIG. 5 shows a view of a further embodiment of the snow glider from below.

On the underside of the glide plate 1, a central, longitudinally extending wide groove 10 is recessed which advantageously continues, with increasing width, in the rear part 6 which is bent upwardly (FIG. 5). The walls of the groove run parallel to the rims of the glider. To increase the directional stability, it can also be advantageous to provide, within the groove 10, a runner 12 in the rear zone of the middle part 5.

On the underside of the rear part 6, two runners 11, enclosing an angle between them, are located symmetrically with respect to the longitudinal axis of the glider (FIG. 5). The runners 11 are offset inwards and extend parallel to the adjacent rims of the glider. They can be fitted to the walls of the wide groove 10.

Instead of fitting only two runners, it would also be possible to provide two groups of grooves or runners, which are arranged symmetrically to each other.

Figure 9:
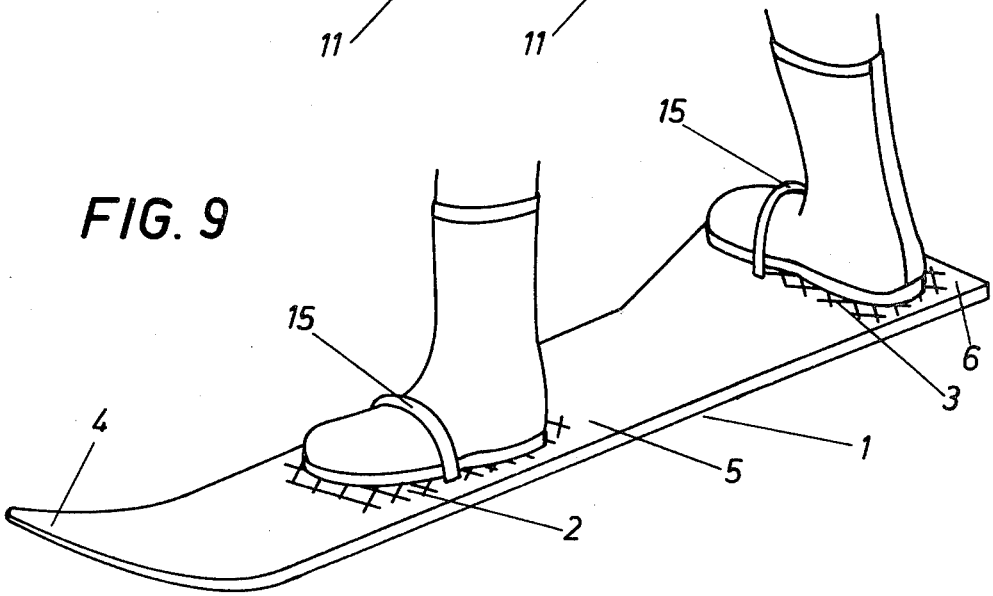

The stand-on areas 2, 3 on the upper side of the glide plate are provided with an anti-skid coating and have holders for the feet. Possible holders are cap-like covers 14 (FIG. 1) or also straps 15 (FIG. 9). These holders 14, 15 are advantageously manufactured from a soft material and are intended to prevent the feet from sliding. They should not be confused with the rigid fixtures of ski bindings, and the user can alight at any time without any problem.

The glide plate 1 of the snow glider is advantageously manufactured from glass fibre-laminated plastic. Other designs in metal, in metal/plastic laminates and the like are also possible. As in the case of a ski, the middle part could, in the state without load, be slightly arched in the longitudinal direction so that a resilient uniform contact pressure is produced on loading.

The holders or covers 14, 15 are arranged in such a way that the foot placed on the rear part of the glide plate stands transversely to the direction of motion, while the front foot placed on the middle part 5 is aligned in the longitudinal direction of the glider or at a slight angle thereto. The holders or covers 14, 15 consist, for example, of rubber or of leather, reduce the risk of injury and give sufficient hold to the user so that bindings and ski boots are not necessary.

As can be seen from FIG. 9, the user stands with both feet in a somewhat straddling position on the glide plate, the upper part of his body and the hands being free. The groove 10 which, depending on the snow conditions to be expected, can be of different depth, ensures good guidance in straight running, and this can be further improved under certain circumstances by the runner 12. To initiate running in a curve, the rear rim edges 13 or runners 9, 11 are brought into play by shifting the weight of the body towards the back and towards the side of the center point of the curve. Depending on the weight distribution, the snow glider can also be braked and brought to a stop.

A further possibility for braking the snow glider consists in fitting a brake device (similar to a ski stopper) to the front stand-on area. When loaded by the foot, the brake device would be ineffective. As soon as the foot is removed, a rocking lever swings downwards under the force of a spring and brakes the glider. This makes instantaneous stopping possible in the case of a fall and eliminates the risk of accidents caused by controlled continued running of the glider.

COMMERCIAL USEFULNESS

The invention is realized by a specific design of a physical object, namely a snow glider. It can thus be commercially exploited paraticularly by industrial production, by the sale or use of these objects and by permitting third parties to perform the activities mentioned against a fee.

We claim:

1. An elongated snow glider plate having a longitudinal axis and an upper surface for receiving thereon both feet of a user comprising
   - a central section having a substantially constant width throughout;
   - a forward end portion bent upwardly to the tip of said glider plate;
   - a rear end portion flared outwardly and upwardly;
   - a lower surface shaped with a longitudinal central groove therein, said groove having a constant width as it extends along said central section, and said groove flaring outwardly as it extends through said rear end portion, said groove including plane side wall surfaces spaced equidistant from the edges of said glider plate; and
   - feet holding means formed as a pair of straps on said upper surface, one of said straps located in said central portion and mounted to extend transversely to the longitudinal axis of said glider plate, and the other of said straps located in said rear end portion and mounted to extend longitudinally with the longitudinal axis of said glider plate.

2. An elongated snow glider plate according to claim 1 wherein a first ridge extends centrally and longitudinally within said groove in said central section.

3. An elongated snow glider plate according to claim 1 wherein said snow glider includes cutting outer edges.

4. An elongated snow glider plate according to claim 3 wherein said cutting outer edges are formed as second ridges.

5. An elongated snow glider plate according to claim 1 wherein a pair of spaced runners are formed on said lower surface spaced symmetrically from said longitudinal axis.

* * * * *